US006095156A

United States Patent [19]

Smith, II

[11] Patent Number: 6,095,156

[45] Date of Patent: Aug. 1, 2000

[54] BEAUTY UTILITY CART WITH STERILIZER

[76] Inventor: Leonard Ray Smith, II, 1032 NE. Main St., Simpsonville, S.C. 29681

[21] Appl. No.: 09/414,231

[22] Filed: Oct. 7, 1999

[51] Int. Cl.[7] ..... A47B 67/02

[52] U.S. Cl. ..... 132/286; 132/333; 422/300; 312/223.6

[58] Field of Search ..... 132/286, 271, 132/272, 333; 422/33, 297, 300, 305, 306; 312/31.01, 280, 223.1, 223.6

[56] References Cited

U.S. PATENT DOCUMENTS

| | | | |
|---|---|---|---|
| 2,447,183 | 8/1948 | Irish et al. | 422/300 |
| 2,943,243 | 6/1960 | Rachman et al. | 312/223.6 |
| 3,375,057 | 3/1968 | Morris | 132/333 |
| 3,460,899 | 8/1969 | Miller | 422/297 |
| 3,489,476 | 1/1970 | Weickgenannt et al. . | |
| 5,379,903 | 1/1995 | Smith . | |
| 5,807,521 | 9/1998 | Franetzki | 422/300 |

*Primary Examiner*—Todd E. Manahan
*Attorney, Agent, or Firm*—Dority & Manning

[57] ABSTRACT

A cabinet storage unit for maintaining electrical clippers and other tools used in the cutting and styling of hair is provided. The cabinet interior defines an air plenum which directs a stream of air across the front face of the cabinet. The cabinet front face defines a plurality of hangers which hold a variety of electric clippers and other hair styling accessories. The cabinet provides a power source and a retractable electric cord to facilitate the use of the clippers along a variable length of an electrical cord. A disinfectant is provided to the air stream and is used to disinfect the tools when the tools are in a storage position. The cabinet is optionally mounted on a wheeled cart to facilitate placement of the cart to and from adjacent barber work stations.

9 Claims, 5 Drawing Sheets

BEAUTY UTILITY CART WITH STERILIZER

BACKGROUND OF THE INVENTION

The present invention relates generally to the art of tool organizers and tool caddies used to hold hand tools and instruments in an organized manner. Barbers typically use multiple sizes or types of electric hair clippers for each customer. Each set of clippers and other power tools is equipped with its own electric cord. The cords have a tendency to become tangled as the multiple instruments are used. As a result, it is not uncommon for the clippers to fall off a storage ledge or to become dislodged from a storage hook. Frequently, the resulting fall may damage the clippers.

One apparatus used in the organization of barber tools is taught in U.S. Pat. No. 5,379,903 to Smith, incorporated herein by reference, in which an apparatus is provided for holding a plurality of barber electric hair clippers in a ready to use position. A plurality of hooks are provided for hanging individual hair clippers and the apparatus provides a similar number of electric cords and cord retractors so as to store the electric cord when the barber tool is not being used.

While the storage apparatus referenced above offers an improvement in the use and storage of barbershop instruments, there remains room for improvement and variation within the art.

SUMMARY OF THE INVENTION

The present invention recognizes and addresses that the foregoing prior art constructions and methods may be varied. Accordingly, it is an object of the present invention to provide an improved storage cabinet for housing electric tools and other accessories used in cutting hair.

It is a further object of the present invention to provide a portable tool organizer which may be easily moved between various work stations.

It is still a further object of the present invention to provide a tool organizer for hair styling instruments.

It is further object of the present invention to provide a tool organizer in which the tools are operatively stored on a pivoting door, the door permitting access to an interior of the storage unit while maintaining the operability of the tools.

It is a further object of the present invention to provide an improved tool organizer which assists in the sterilization of the stored cutting instruments.

It is a more particular object of the present invention to provide a storage apparatus which provides a flow of air, having a disinfectant therein, across the tools.

Some of these objects are achieved by a storage unit which defines an upright having a substantially planar surface which defines a plurality of support members adapted for engaging at least one hair styling accessory having an electric cord. The substantially planar surface further defines at least one aperture adapted for receiving therethrough the electrical cord of the styling accessory. An air plenum defined in part by a rear of the substantially planar surface is in communication with an air outlet along an upper margin of the substantially planar surface. The air plenum is in further communication with an air inlet along a lower margin of the substantially planar surface. At least one fan is operatively disposed within the air plenum for receiving an air supply from the inlet and directing the air flow toward the outlet. A disinfectant is introduced within the air flow pathway, thereby exposing any tools or instruments on the substantially planar surface to a constant flow of a disinfectant. The tools' electric cords are connected to a source of operating voltage, the electrical cords being supported on a storage reel which automatically retracts any unused cord length when the instrument is in a stored position.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENTS

Reference now will be made in detail to preferred embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in, or are obvious from, the following detailed description. It is to be understood by one of ordinary skill in the art that the present discussion is a description of exemplary embodiments only and is not intended as limiting the broader aspects of the present invention, which broader aspects are embodied in the exemplary constructions.

Figure 1:
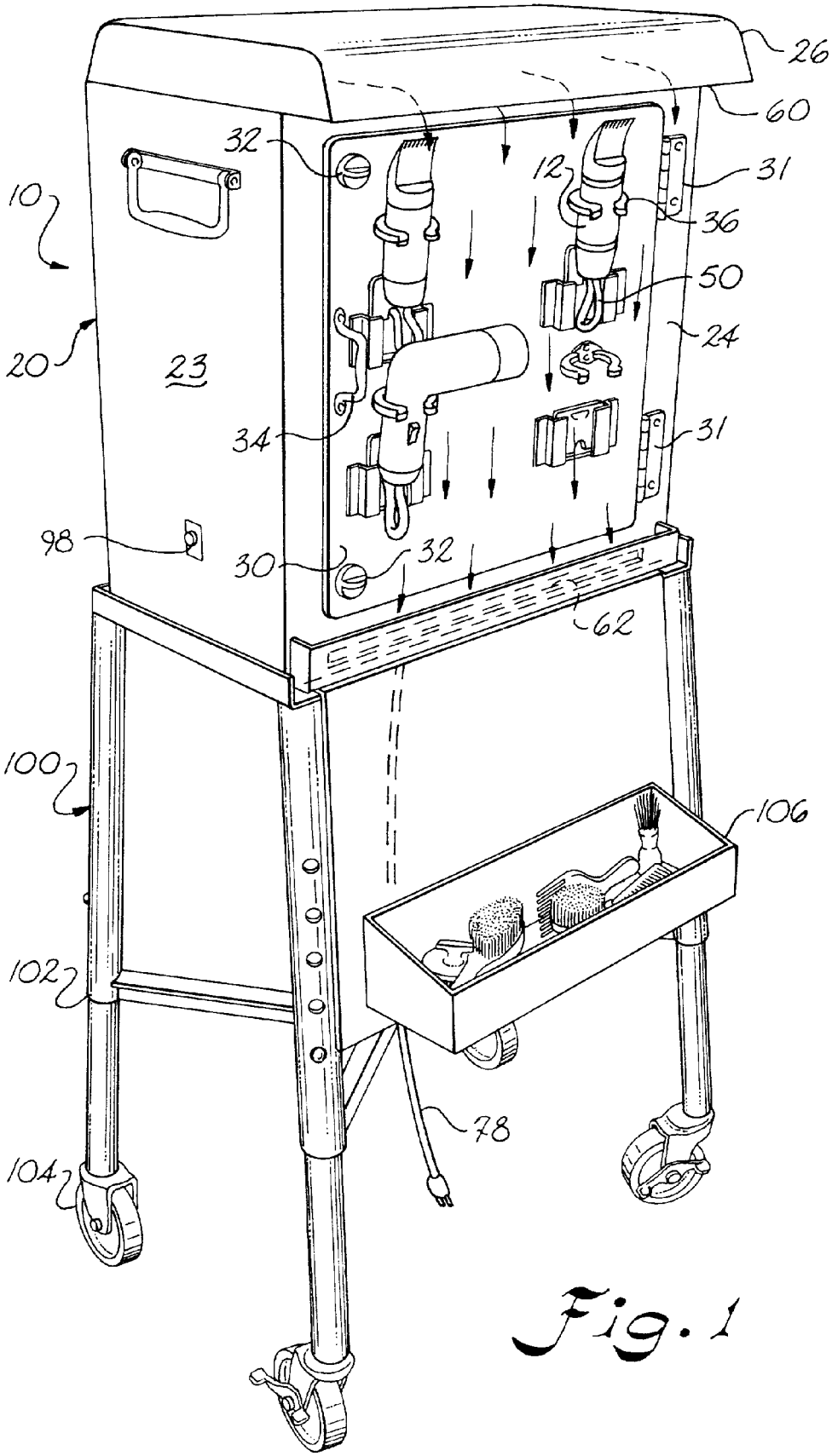
FIG. 1 is a perspective representation of a barber tool storage apparatus constructed in accordance with the present invention.

FIG. 1 illustrates the beauty utility cart storage apparatus 10 for holding one or more barber's clippers 12 or related tools. As more particularly described below, the apparatus 10 further comprises a cabinet 20 having a top 21 (FIG. 3), a bottom 22, a pair of opposite sides 23, a front 24, and a rear 25. A hood 26 is carried a spaced distance above top 21 and defines a front margin which extends beyond the vertical plane of the front 24. The cabinet front 24 further defines a door 30 secured by a pair of hinges 31.

Along the door edge opposite the hinges 31, a handle 34 is provided which permits the leading edge of the door to pivot outwardly. Locks 32 are provided to secure the door in a closed position. Mounted on the surface of door 30 are a plurality of holders 36 which may take the form of any conventional clip, hook, hanger, clasp, or magnetic plate. Further, it is envisioned that the holders 36 may have one or more prongs which articulate to provide an adjustable securing mechanism for an associated clipper 12 or other hair cutting accessory.

Spaced beneath each holder 36 is a corresponding bracket 40 which defines a receiving slot 42 between the door surface and a portion of a rear surface of bracket 40 and opposite a rectangular opening 38 defined by door 30. A lower rectangular edge wall 44 of bracket 40 traverses the width of the bracket and is adapted for receiving a leading edge of slide member 46. Slide member 46 defines a notch 48 along the leading edge, notch 48 adapted for engaging an outer circumference of an electrical cord 50.

Figure 3:
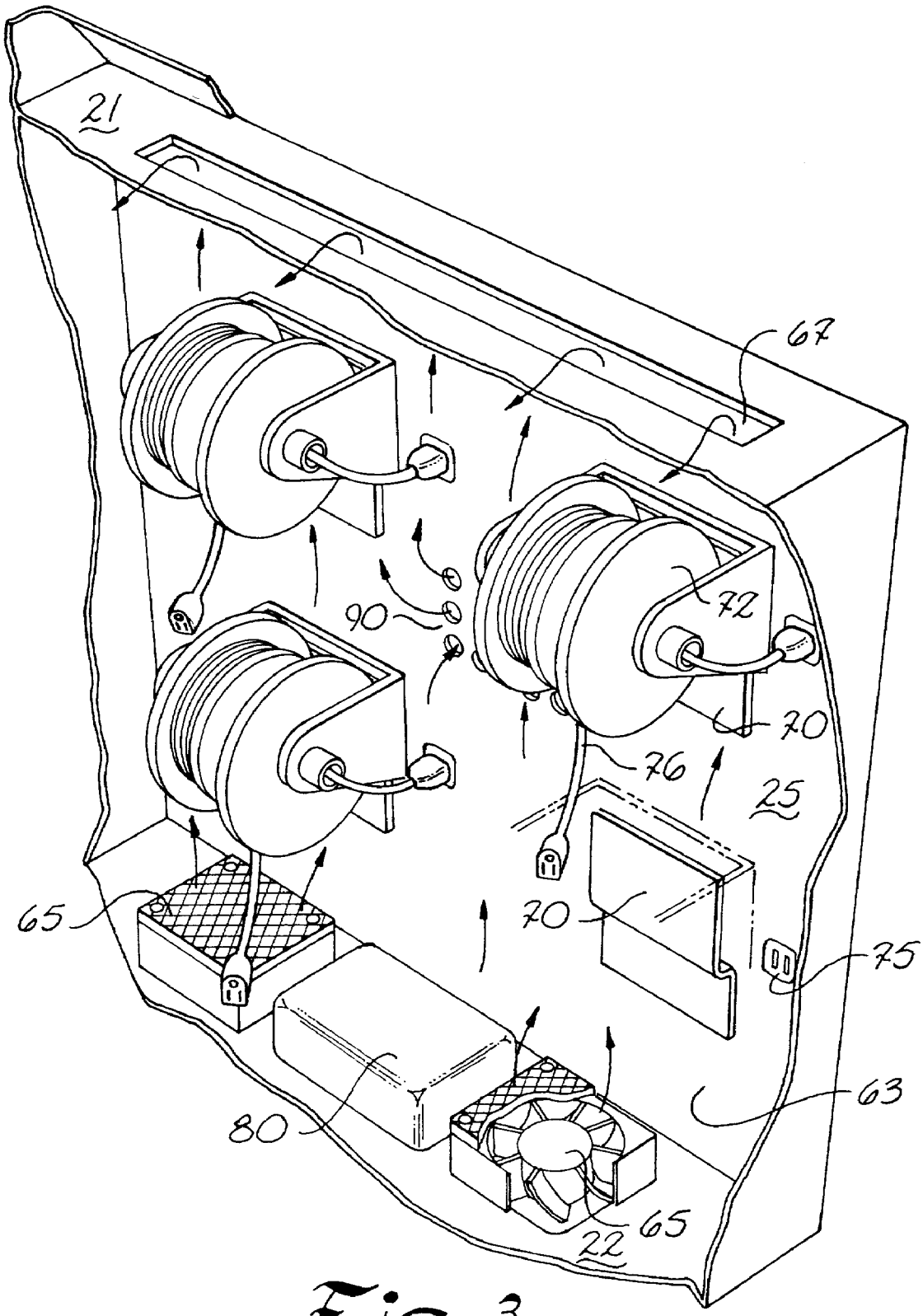
FIG. 3 is a perspective view of the interior rear wall of the storage apparatus as seen in FIG. 1.
Figure 4:
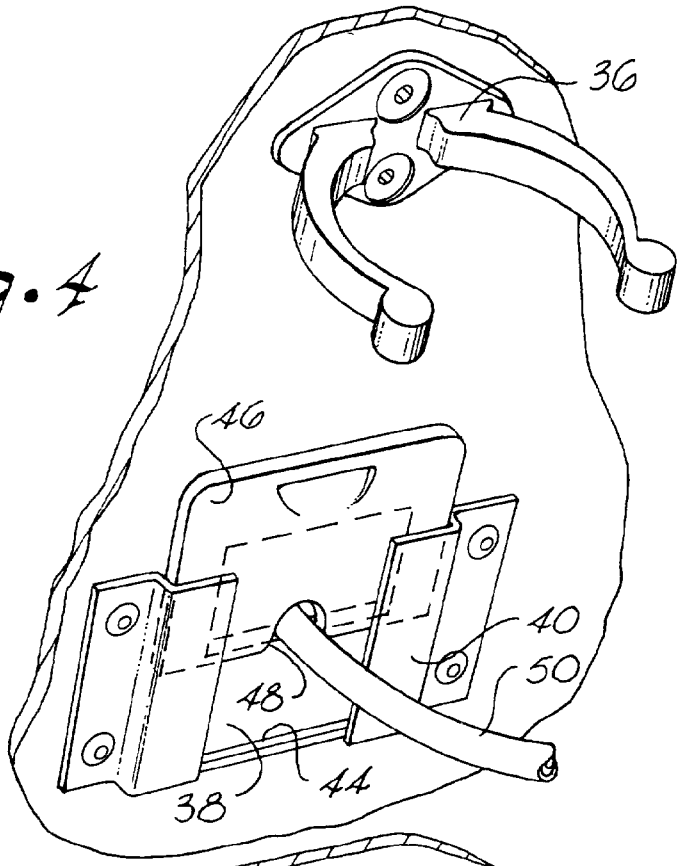
FIG. 4 is a close-up perspective view of a holder and a cord bracket which are present on the front of the storage apparatus as seen in FIG. 1.
Figure 5:
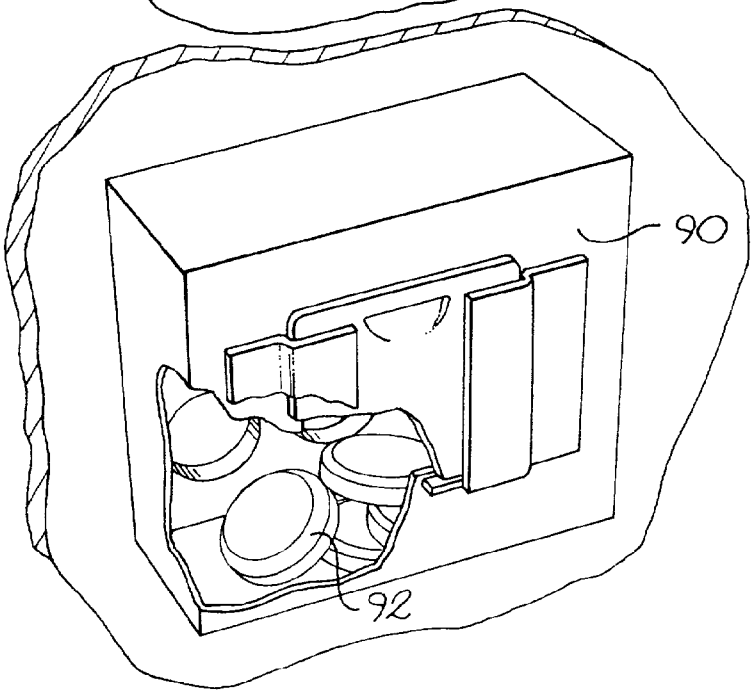
FIG. 5 is an enlarged perspective view in partial section of a disinfectant holder and attachment bracket associated with the storage apparatus as seen in FIG. 1.
Figure 6:
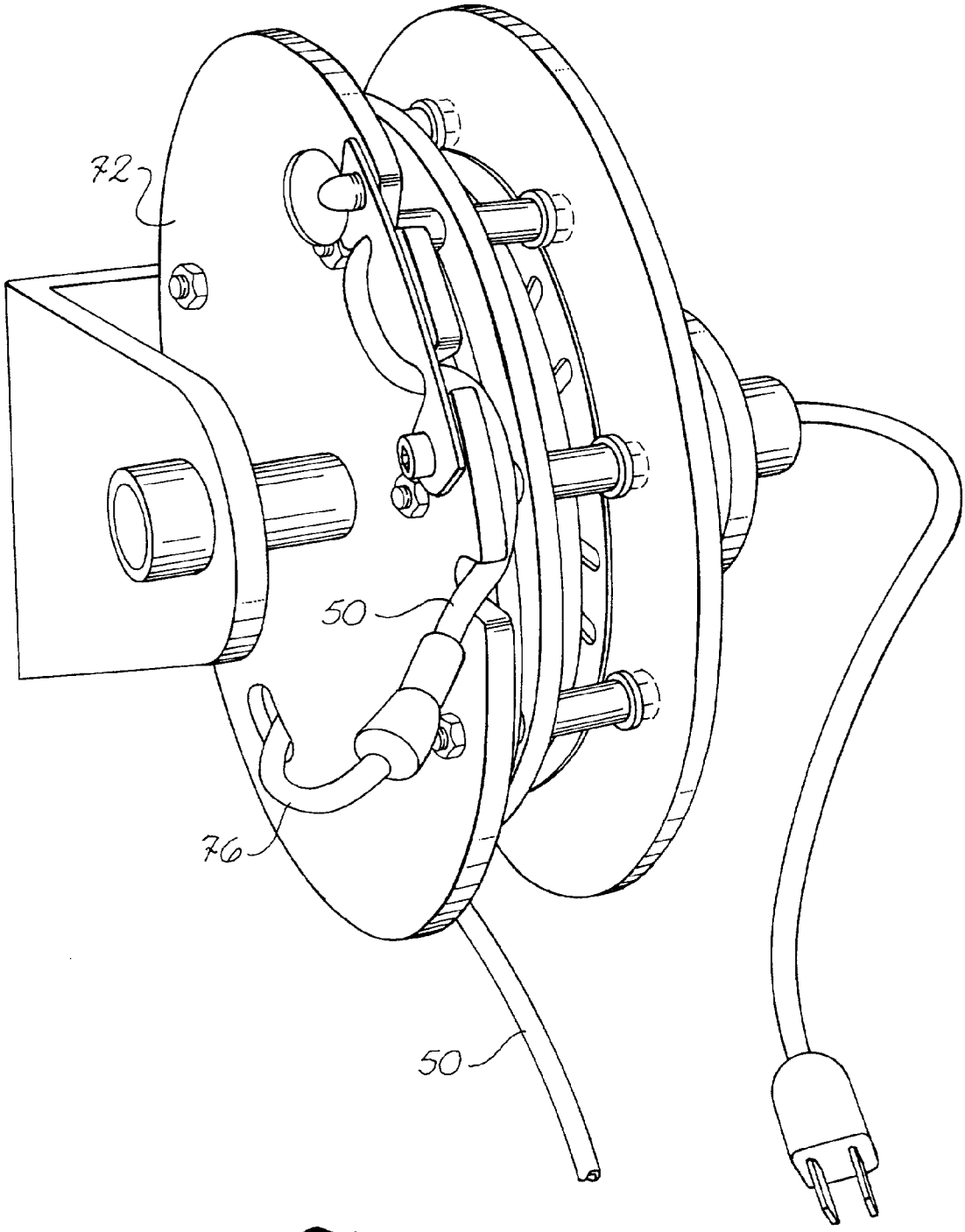
FIG. 6 is a perspective view of a single cord holder and retractor associated with the tool storage apparatus as seen in FIG. 1.

As best seen in reference to FIG. 3, an interior of cabinet 20 defines an air plenum 63. One or more fans 65 are used to establish an air flow pathway (directional arrows) which enters from the bottom 22 of cabinet 20 to the cabinet top 21. As the air flow exits cabinet top 21 along slit 67, hood 26 directs the air flow to an outlet 60 defined by a lower edge of hood 26. The air flow is directed across the surface of door 30, making intimate contact with clippers 12 or other accessories held by brackets 40. An intake vent 62, positioned along the lower edge of the cabinet front 24, receives the air flow which is directed back into plenum 63 and thereby completes the air flow pathway.

Operatively disposed within the air plenum stream of air is a holder 90 adapted for housing and dispensing a disinfectant 92. Disinfectant 92, seen presently in the form of a plurality of tablets, may be provided by a formaldehyde tablet or other disinfectant solid which sublimes to a gaseous state. Alternatively, various liquids may be used and, if desired, introduced into the air stream with various dispensing units such as atomisizers or other releasing mechanisms which introduce a source of fluidized particles within the air stream.

As seen in FIG. 3, the inner surface of cabinet rear wall 25 carries a plurality of hangers 70 from which storage spools 72 are supported. Storage spools 72 are designed to hold a length of electrical cord 76. Preferably, the storage spools 72 are spring-tensioned as is well known in the art to allow a desired length of cord 76 to be unrolled and maintained in a dispensed state from spool 72. Upon activation of spool 72, the spool will automatically retract the unspooled length of electrical cord 76.

Figure 2:
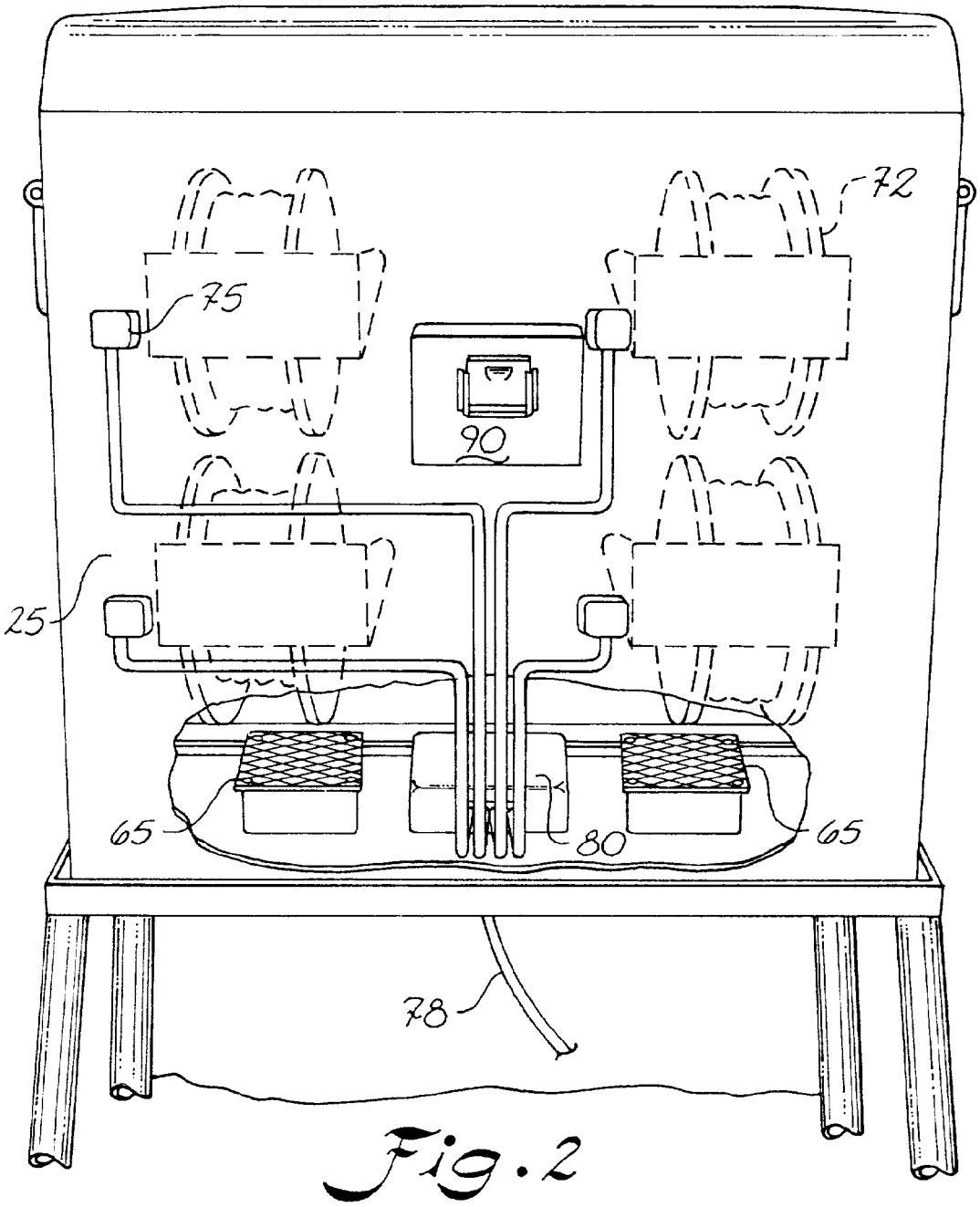
FIG. 2 is a rear view of the storage apparatus as seen in FIG. 1 showing additional internal details of the apparatus.

A male end of each electrical cord 76 plugs into a respective receptacle 75 defined within the rear wall 25. Each receptacle 75 is in communication with a common power supply 80 (see FIG. 2). Power supply 80 is, in turn, connected to an operating source of electric power via cord 78. An on/off switch 98 may be provided which allows independent control and operation of the fans 65.

As seen in reference to FIG. 1, the storage apparatus 10 may be secured to a cart 100, cart 100 having a plurality of telescoping legs 102. Each leg 102 is supported by a lower wheel or caster 104 to facilitate movement of the storage apparatus 10. An optional storage box 106 may be mounted along the front of cart 100 to house brushes, powders, sprays, or other accessories.

The storage cabinet described above provides a readily accessible surface to store and display a variety of clippers and tools commonly used by a barber or hair stylist. For instance, an electric clipper 12 can be positioned within bracket 40 in which the clipper electrical cord 50 is inserted behind slide 46 and through door 30. The electrical plug associated with clipper cable 50 may be secured to any one of the plurality of spooled electrical wire 76. The retractable nature of the spools permits door 30 to be opened while the clippers and other supplies remain electrically connected to the associated cord. This ability facilitates the connection of the electrical supplies and facilitates the replenishment of the disinfectant supply.

The resulting air curtain which is established along the front face of door 30 carries therein a source of a disinfectant. The disinfectant helps to maintain the clippers 12 and other accessories in a sanitary state. Further, the moving air supply can provide a drying action to hard surfaced instruments such as scissors, combs, razors, and similar devices. Such items are often immersed in a liquid sterilizing fluid which must then be removed or dried. By placing these items within the moving air flow stream, the tools are quickly dried and the sterility is maintained by the sterilizing agent present within the air stream.

The wheeled cart 100 allows a single storage cabinet to be easily moved between various work stations. In addition, the cabinet also lends itself to a more permanent installation or location along a shelf or other work table.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A storage apparatus for hair cutting tools and accessories comprising:

an upright having a substantially planar surface and defining a plurality of support members adapted for engaging at least one hair styling accessory having an electric cord, the substantially planar surface further defining at least one aperture adapted for receiving therethrough the electric cord;

an electrical conduit for connecting the electrical cord to a source of operating voltage;

an air plenum defined in part by a rear of the substantially planar surface, the air plenum further defining and in communication with an air outlet along the upper margin of the substantially planar surface and an air inlet along a lower margin of the substantially planar surface;

at least one fan operatively disposed within the air plenum for receiving an air supply from the inlet and directing the air supply toward the outlet; and a disinfectant placed within the air flow pathway.

2. The apparatus according to claim 1 wherein the substantially planar surface is provided by an exterior surface of a cabinet, the interior surface of the cabinet further defining the air plenum.

3. The apparatus according to claim 2 wherein the electrical conduit further comprises a retractable spooled electrical cord.

4. The apparatus according to claim 2 wherein the cabinet front further defines a hinged door, surface of the door supporting the plurality of support members.

5. A storage apparatus for hair styling instruments comprising:

a cabinet defining an enclosure and having a front, a back, two sides, a top, and a bottom, the cabinet front further defining a reclosable door, a surface of the door supporting a plurality of holders for securing at least one hair styling instrument;

a guide member supported by the door and adapted for engaging an exterior of an electric cord of the hair styling instrument as the electric cord extends through an opening of the door positioned behind the guide member;

a plurality of electrical conduits carried on a like number of cord retractors, each of the cord retractors supported by a respective bracket attached to an interior wall of the cabinet;

an air plenum defined within the interior of the cabinet, the air plenum in communication with an air outlet operatively disposed along an upper edge of the cabinet front and in further communication with an air inlet along a lower edge of the cabinet front;

a dispenser in fluid communication with the air plenum, the dispenser adapted for the release of a sterilizing agent;

a fan operatively disposed within the air plenum; and a power supply in communication with the fan and in further communication with each of the plurality of the electrical conduits.

6. A process of storing barber tools in an operative condition comprising:

supplying a cabinet having an interior air plenum and an exterior mounting surface;

attaching a plurality of barber tools to the exterior mounting surface;

circulating an air stream through the plenum;

releasing into the air stream a disinfecting agent;

discharging the air stream and the disinfecting agent along the exterior mounting surface.

7. The process according to claim 6 wherein the step of attaching a plurality of barber tools to the exterior mounting surface further provides for connecting the barber tools to a power source.

8. The process according to claim 7 wherein the step of connecting the tools to a power source further includes connecting the tools to a retractable electrical cord, the retractor housed within an interior of the cabinet.

9. The process according to claim 6 wherein said releasing step includes passing the air stream over a disinfectant tablet of formaldehyde.

* * * * *